US009375854B2

(12) United States Patent
Chu et al.

(10) Patent No.: US 9,375,854 B2
(45) Date of Patent: Jun. 28, 2016

(54) OUT THE FRONT ASSISTED KNIFE WITH A SECONDARY PUSHER

(71) Applicants: Ji-Tung Chu, New Taipei (TW); Jiun-Yu Chu, New Taipei (TW)

(72) Inventors: Ji-Tung Chu, New Taipei (TW); Jiun-Yu Chu, New Taipei (TW)

( * ) Notice: Subject to any disclaimer, the term of this patent is extended or adjusted under 35 U.S.C. 154(b) by 211 days.

(21) Appl. No.: 14/186,448

(22) Filed: Feb. 21, 2014

(65) Prior Publication Data

US 2015/0239135 A1 Aug. 27, 2015

(51) Int. Cl.
*B26B 1/08* (2006.01)

(52) U.S. Cl.
CPC ..... *B26B 1/08* (2013.01)

(58) Field of Classification Search
CPC ..... B26B 1/08
USPC ..... 30/162
See application file for complete search history.

(56) References Cited

U.S. PATENT DOCUMENTS 845,792 A * 3/1907 Jenkins ..... B26B 1/08 30/162
3,895,441 A * 7/1975 Horak ..... F41B 13/00 30/162
4,139,939 A * 2/1979 Crooks ..... B26B 5/003 30/162
4,265,017 A * 5/1981 Collins ..... B26B 1/08 30/162
5,337,481 A * 8/1994 Mears ..... B26B 5/008 30/162
5,344,424 A * 9/1994 Roberts ..... A61B 17/3213 30/162
5,371,948 A * 12/1994 Liffiton ..... B26B 5/001 30/162
5,511,261 A * 4/1996 Collins ..... B25B 13/56 30/162
5,584,123 A * 12/1996 Chi ..... B23D 51/01 30/125
5,620,454 A * 4/1997 Pierce ..... A61B 17/32 30/162
5,862,596 A * 1/1999 Chung ..... B26B 5/001 30/162
6,006,433 A * 12/1999 Baltazar ..... B26B 5/001 30/152
6,085,423 A * 7/2000 Marifone ..... B26B 1/08 30/151
6,314,646 B1 * 11/2001 Schmidt ..... B26B 5/001 30/125
6,363,614 B1 * 4/2002 Umstead ..... B23D 51/01 30/144
7,153,317 B2 * 12/2006 Kanodia ..... A61B 17/3211 30/162
8,572,852 B1 * 11/2013 Jennings ..... B26B 5/001 30/162
8,671,578 B1 * 3/2014 Frazer ..... B26B 1/08 30/151
2006/0130340 A1 * 6/2006 Berns ..... B26B 5/003 30/162
2006/0207102 A1 * 9/2006 Bezold ..... B26B 1/08 30/162
2007/0107233 A1 * 5/2007 Polei ..... B26B 5/003 30/162
2007/0175045 A1 * 8/2007 McHenry ..... B26B 1/08 30/162
2008/0222897 A1 * 9/2008 Marfione ..... B26B 1/08 30/162
2014/0150268 A1 * 6/2014 Billado, Jr. ..... B26B 1/02 30/162
2014/0173912 A1 * 6/2014 Scimone ..... B26B 5/003 30/162
2014/0182140 A1 * 7/2014 Rosenhan ..... B26B 5/003 30/162
2014/0208596 A1 * 7/2014 Constantine ..... B26B 1/08 30/162
2014/0250695 A1 * 9/2014 Wagner ..... B26B 5/003 30/162
2014/0366385 A1 * 12/2014 Herlitz ..... B26B 5/001 30/162
2015/0258696 A1 * 9/2015 Wang ..... B26B 5/001 30/162
2016/0023364 A1 * 1/2016 Raymond ..... B26B 1/08 30/162
2016/0031097 A1 * 2/2016 Wu ..... B26B 1/08 30/162

* cited by examiner

*Primary Examiner* — Sean Michalski
(74) *Attorney, Agent, or Firm* — patenttm.us

(57) ABSTRACT

An out the front assisted knife has a casing, a blade and a secondary pusher. The casing has a secondary channel hole formed through the casing, extending axially, and disposed away from an axial inner end of the casing. The secondary pusher is axially movably mounted in the casing, protrudes out of the secondary channel hole of the casing, and axially abuts against the inner end of the blade. The secondary pusher is disposed away from the axial inner end of the casing, such that the user's hand holds at least half of the casing when pressing the thumb on the secondary pusher to extend the blade. Therefore, the user can hold the knife by the center of gravity of the knife, and thus can stably and conveniently operate the knife, thereby preventing the knife from dropping accidentally.

11 Claims, 11 Drawing Sheets

OUT THE FRONT ASSISTED KNIFE WITH A SECONDARY PUSHER

BACKGROUND OF THE INVENTION

1. Field of the Invention

The present invention relates to an out the front assisted knife, especially to an out the front assisted knife that has a secondary pusher that assists the user to extend the blade out more securely.

2. Description of the Prior Arts

An out the front assisted knife (OTF assisted knife) has a blade that has to be pushed for a distance manually and then a resilient element takes over and extends the blade out the front of the knife. A conventional OTF assisted knife comprises a casing, a blade, a pusher, an engager and a spring. The casing has an inner space and an opening. The blade is moveably mounted in the casing. An outer end of the blade selectively protrudes out of the opening of the casing. The pusher is moveably mounted on an outer wall of the casing, and is connected to an inner end of the blade. The engager is moveably mounted in the casing, and is connected pivotally to the inner end of the blade. The spring is mounted in the casing. One of two ends of the spring is connected to the casing and is adjacent to the opening of the casing. The other end of the spring is connected to the engager.

When not in use, the blade is fully retracted in the casing, and the engager is rotated by the spring to engage with an inner wall of the casing.

To extend the blade, a user pushes the pusher to move the blade. The movement of the blade makes the engager resist the spring and gradually rotate in a reverse direction. After the user moves the blade for a distance, the engager departs from and no longer engages with the inner wall of the casing because of reverse rotation. Then, the spring pushes the blade out of the opening of the casing rapidly without obstruction, and the extending of the blade is accomplished.

To retract the blade, the user pulls the pusher, which is moved adjacent to the opening of the casing, back to an inner end of the casing. Then, the engager rotates and engages with the inner wall of the casing again, and the blade is fully retracted and fixed in the casing again.

However, the conventional OTF assisted knife has the following shortcomings. The pusher is disposed adjacent to the inner end of the casing, such that the user can only grip the inner end of the casing and cannot hold the knife by the center of gravity of the knife when extending the blade and pressing the thumb on the pusher. Thus, the user may have difficulty controlling the knife to extend the blade out. Besides, the knife, which is not held firmly, may drop from the hand because of the shock generated when the blade is pushed out and hits an outer end of the casing. The blade of the dropping knife already extends out of the casing and may harm the user.

To overcome the shortcomings, the present invention provides an out the front assisted knife to mitigate or obviate the aforementioned problems.

SUMMARY OF THE INVENTION

The main objective of the present invention is to provide an out the front assisted knife that can be held firmly when a blade of the knife extends.

The out the front assisted knife has a casing, a blade and a secondary pusher. The casing has a secondary channel hole formed through the casing, extending axially, and disposed away from an axial inner end of the casing. The blade is axially movably mounted in the casing. The secondary pusher is axially movably mounted in the casing, protrudes out of the secondary channel hole of the casing, and axially abuts against the inner end of the blade.

Compared to the conventional OTF assisted knife, the present invention further has the secondary pusher for the user to extend the blade out. The secondary pusher is disposed away from the axial inner end of the casing, such that the user's hand holds at least half of the casing when pressing the thumb on the secondary pusher to extend the blade. Therefore, the user can hold the knife by the center of gravity of the knife, and thus can stably and conveniently operate the knife, thereby preventing the knife from dropping accidentally.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
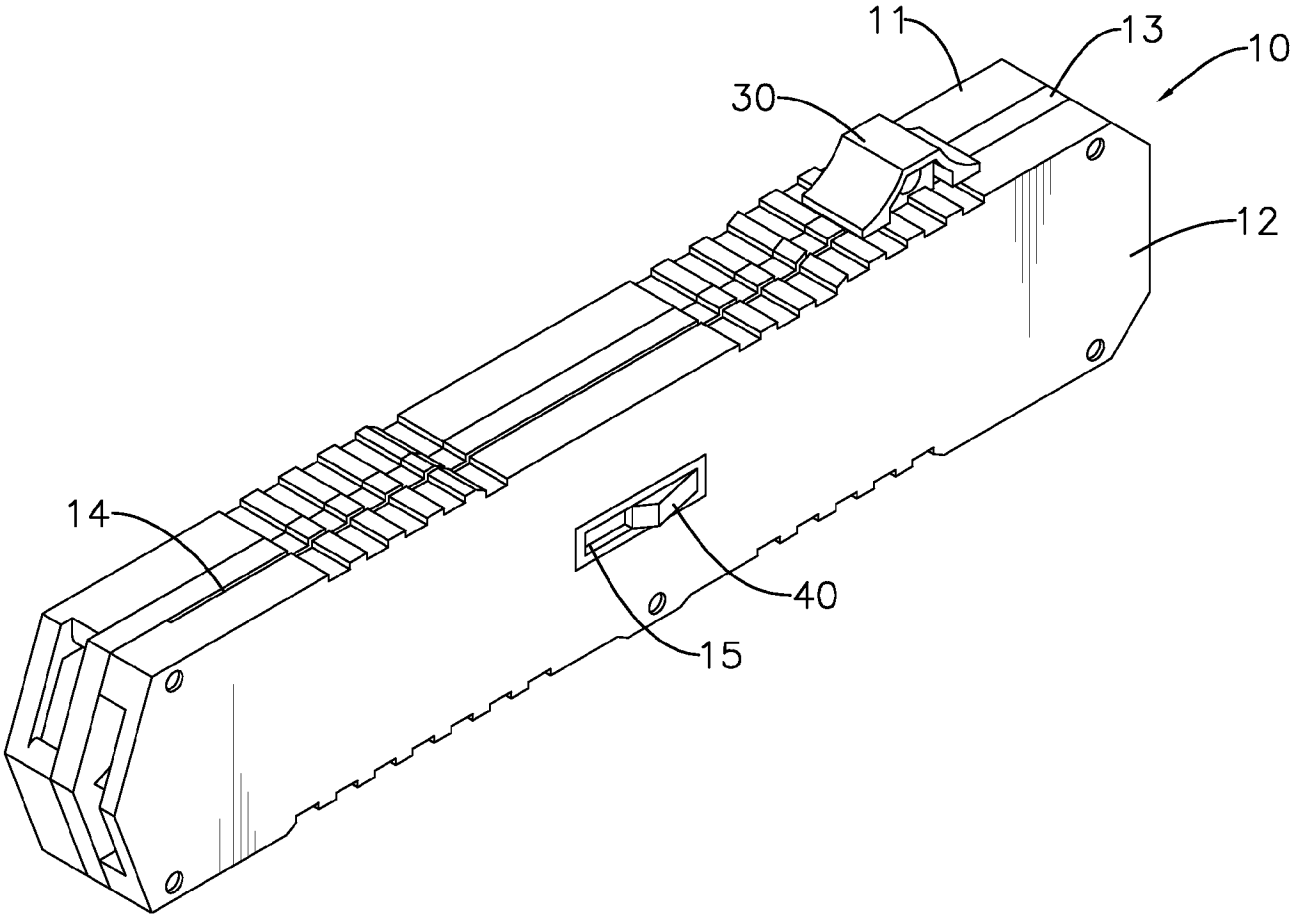
FIG. 1 is a perspective view of an out the front assisted knife in accordance with the present invention.
Figure 2:
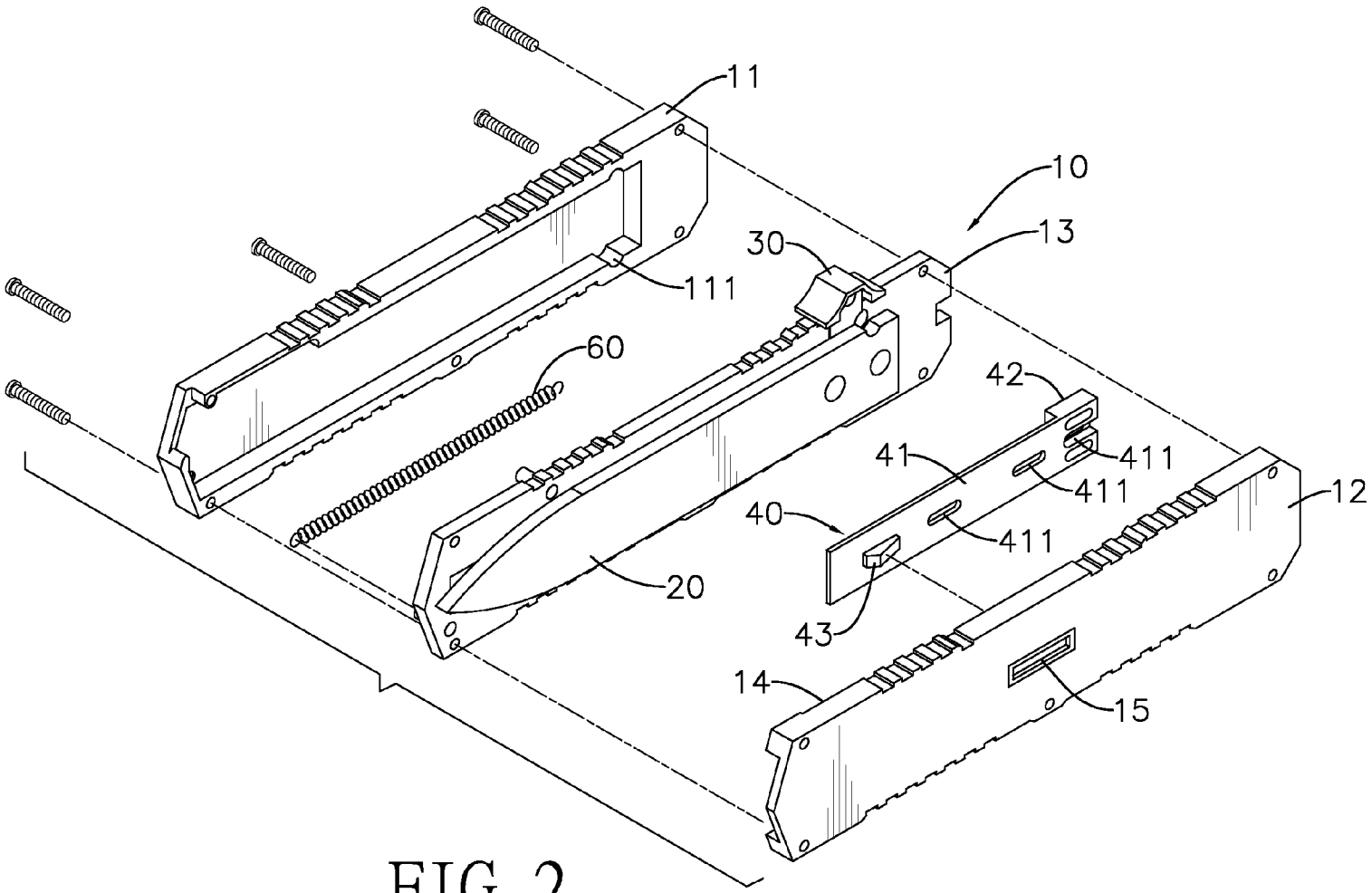
FIG. 2 is an exploded perspective view of the out the front assisted knife in FIG. 1.
Figure 3:
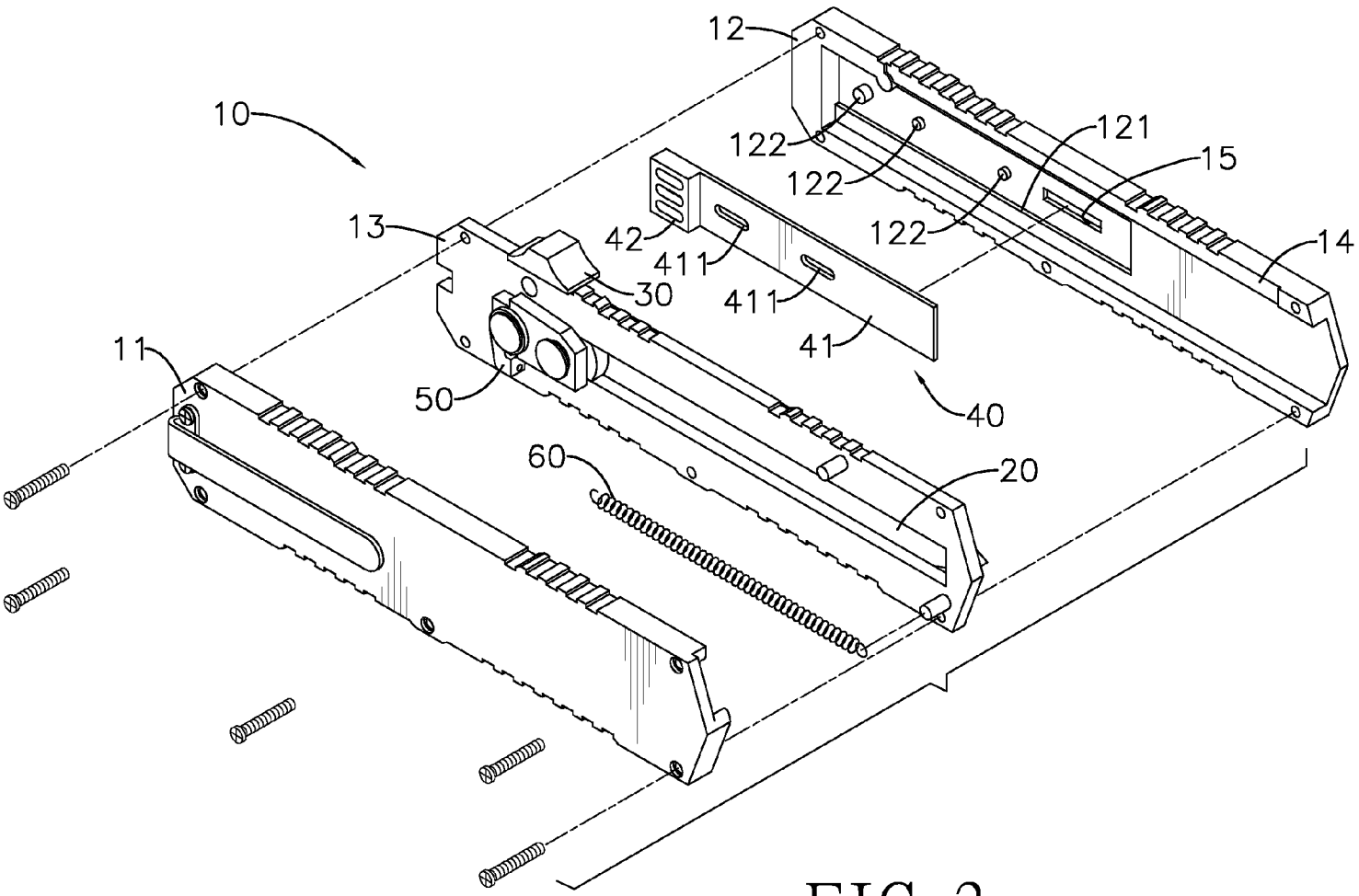
FIG. 3 is another exploded perspective view of the out the front assisted knife in FIG. 1.

With reference to FIGS. 1 to 3, an out the front assisted knife in accordance with the present invention comprises a casing 10, a blade 20, a primary pusher 30, a secondary pusher 40, an engager 50 and a resilient element 60.

Figure 4:
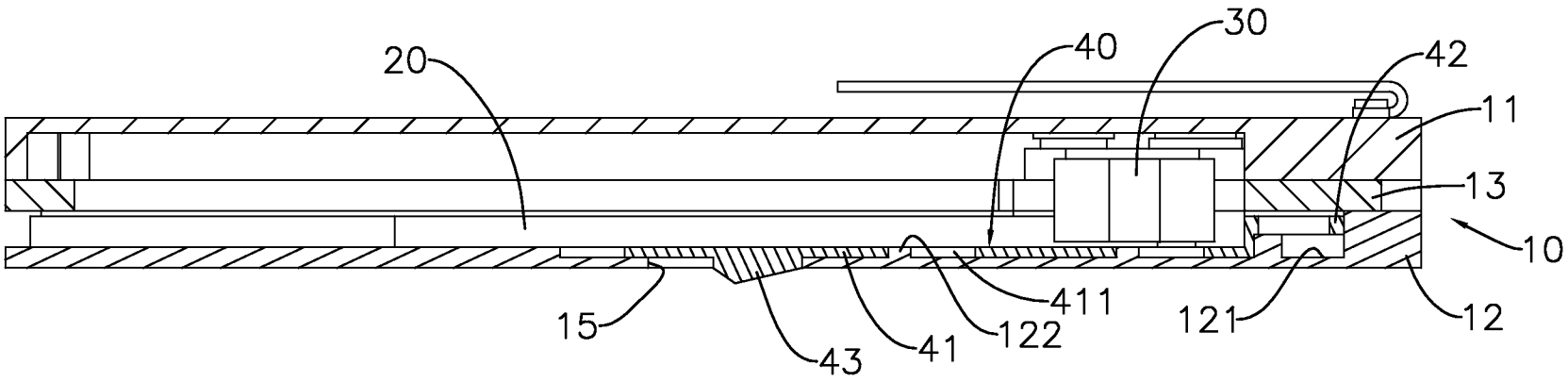
FIG. 4 is a top view in partial section of the out the front assisted knife in FIG. 1.

The casing 10 is elongated, and has an axial inner end and an axial outer end opposite to each other. The casing 10 further has a first side casing 11, a second side casing 12 and a channel board 13. The channel board 13 is mounted between the first side casing 11 and the second side casing 12. The first side casing 11 and the channel board 13 form an inner space. The first side casing 11 has an engaging part 111 formed transversely in an inner wall of the first side casing 11. The second side casing 12 and the channel board 13 form an inner space and an opening. The opening is disposed in the axial outer end of the casing 10. A top side of the second side casing 12 and a top side of the channel board 13 form a primary channel hole 14. The primary channel hole 14 extends axially, and two ends of the primary channel hole 14 are respectively adjacent to the axial inner end and the axial outer end of the casing 10. The second side casing 12 has a panel recess 121, a secondary channel hole 15 and multiple positioning pins 122. The panel recess 121 is formed transversely in an inner wall of the second side casing 12, and extends axially. The secondary channel hole 15 is formed through a bottom of the panel recess 121, communicates with the panel recess 121, extends axially, and is disposed away from the axial inner end of the casing 10. In a preferred embodiment, the secondary channel hole 15 is disposed in an axial middle part of the casing 10, and preferably, a distance between the secondary channel hole 15 and the axial inner end of the casing 10 is equal to a distance between the secondary channel hole 15 and the axial outer end of the casing 10 as shown in FIG. 4. The positioning pins 122 are formed transversely on the bottom of the panel recess 121, and are axially arranged apart from one another.

With reference to FIGS. 2 to 4, the blade 20 is axially movably mounted between the channel board 13 and the second side casing 12, and has an outer end and an inner end opposite to each other. The outer end of the blade 20 selectively protrudes out of the opening of the casing 10.

With reference to FIGS. 1 to 3, the primary pusher 30 is axially movably mounted on a top side of the casing 10, is mounted through the primary channel hole 14 of the casing 10, and is connected to the inner end of the blade 20.

With reference to FIGS. 2 to 4, the secondary pusher 40 is axially movably mounted between the channel board 13 and the second side casing 12, and has a panel 41, an abutting part 42 and an operating part 43. The panel 41 is mounted between the channel board 13 and the second side casing 12, extends axially, corresponds to the panel recess 121 of the second side casing 12 in shape, is axially moveably mounted in the panel recess 121, and has multiple positioning holes 411. Each positioning hole 411 extends axially, and is disposed around a corresponding one of the positioning pins 122 of the second side casing 12. The abutting part 42 is formed transversely on an inner end of the panel 41, and axially abuts against the inner end of the blade 20 as shown in FIG. 4. The operating part 43 is formed transversely on the panel 41, is disposed adjacent to an outer end of the panel 41, and protrudes out of the secondary channel hole 15 of the second side casing 12. The operating part 43 and the abutting part 42 are formed in opposite transverse directions on the panel 41.

Figure 5:
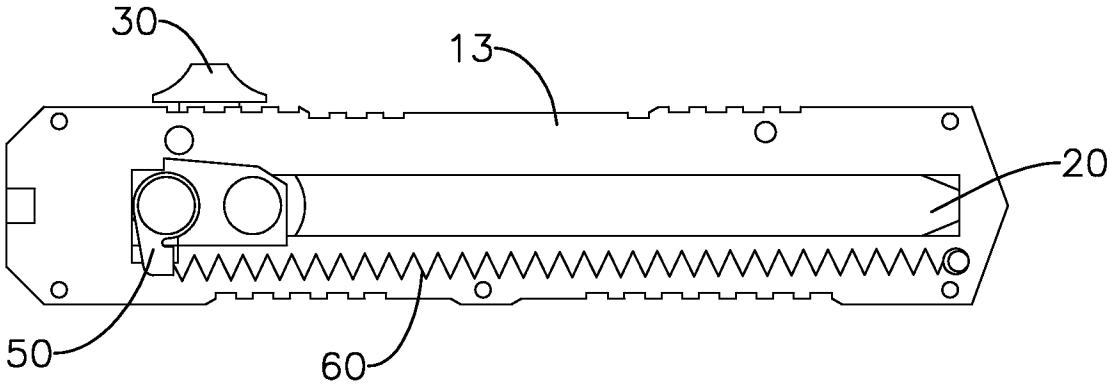
FIG. 5 is an operational left side view of the out the front assisted knife in FIG. 1, showing a blade retracted in a casing.

With reference to FIGS. 2, 3 and 5, the engager 50 is axially movably mounted between the channel board 13 and the first side casing 11, is pivotally connected to the inner end of the blade 20, and selectively engages with the engaging part 111 of the first side casing 11.

The resilient element 60 is mounted between the channel board 13 and the first side casing 11. In a preferred embodiment, the resilient element 60 is a spring. One of two ends of the resilient element 60 connects to the casing 10 and is adjacent to the opening of the casing 10. The other end of the resilient element 60 connects the engager 50.

Figure 8:
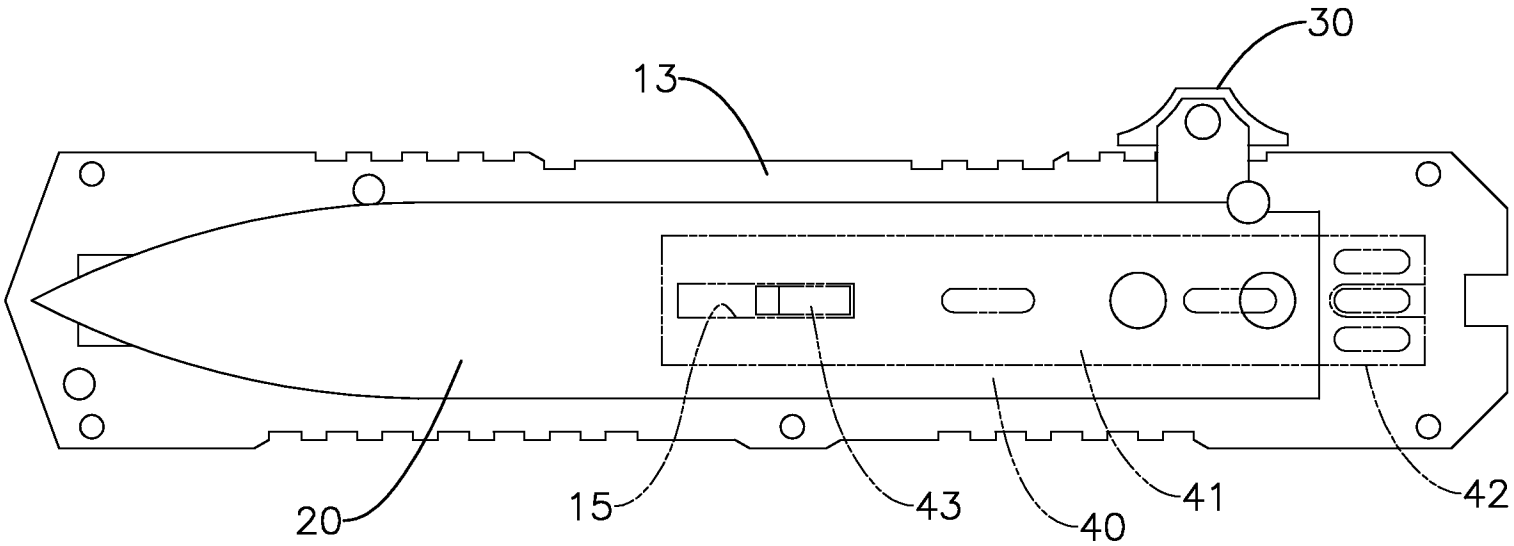
FIG. 8 is an operational right side view of the out the front assisted knife in FIG. 1, showing the blade retracted in the casing.

With reference to FIGS. 5 and 8, when not in use, the blade 20 is retracted in the casing 10. The engager 50 is rotated relative to the blade 20 by the resilient element 60, and thus engages with the engaging part 111 of the first side casing 10. Therefore, the blade 20 can be maintained in retraction in the casing 10.

Figure 6:
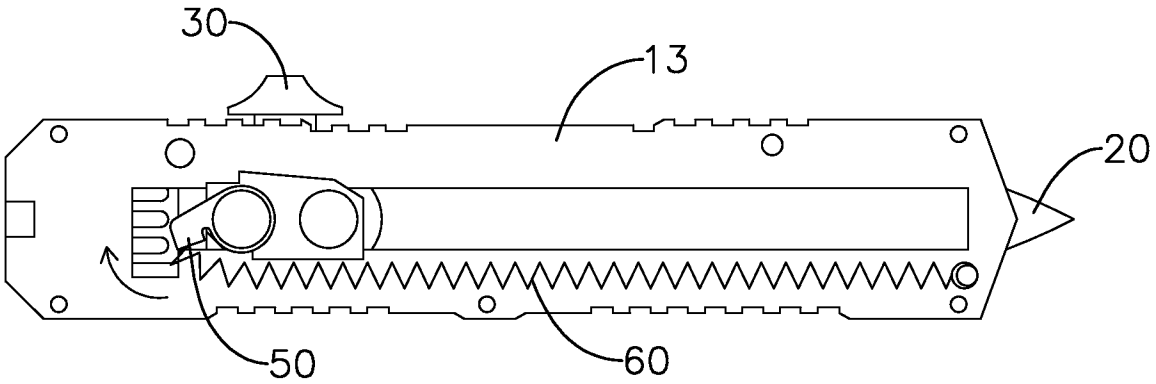
FIG. 6 is an operational left view of the out the front assisted knife in FIG. 1, showing the moment when an engager is departing from an engaging part.
Figure 7:
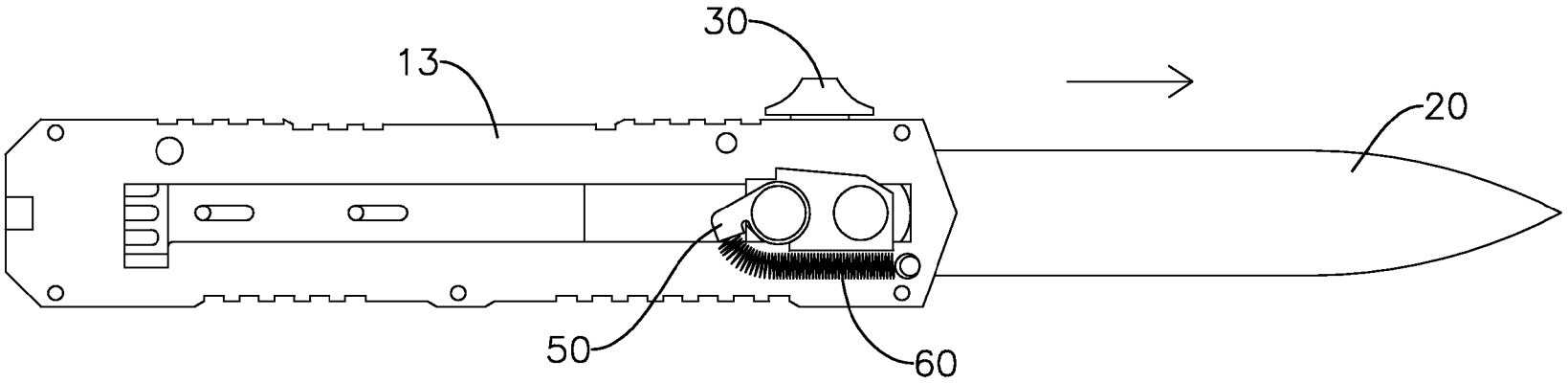
FIG. 7 is an operational left view of the out the front assisted knife in FIG. 1, showing the blade extending out of the casing.
Figure 9:
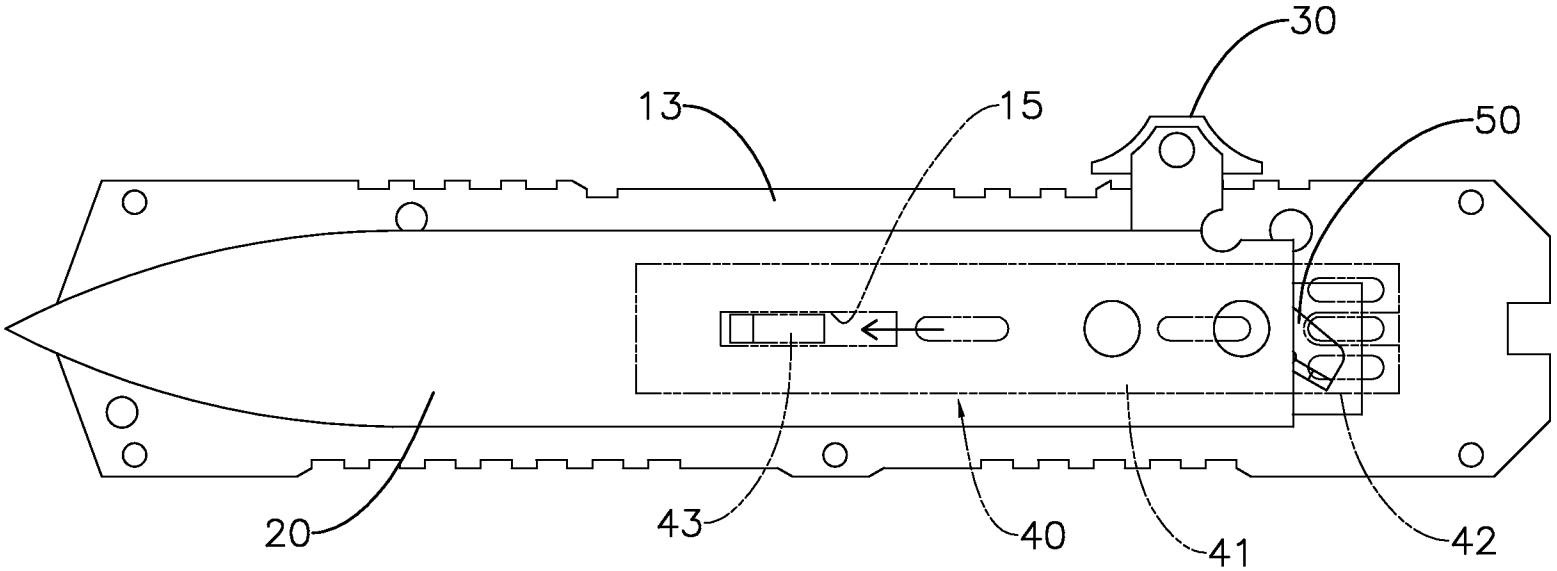
FIG. 9 is an operational right view of the out the front assisted knife in FIG. 1, showing the moment when the engager is departing from the engaging part.

With reference to FIGS. 6 and 9, to extend the blade 20, a user holds the rear half part of the casing 10, and presses the thumb on the operating part 43 of the secondary pusher 40, so as to push the secondary pusher 40. Accordingly, the abutting part 42 of the secondary pusher 40 pushes the blade 20, and the movement of the blade 20 makes the engager 50 rotate reversely relative to the blade 20 and gradually depart from the engaging part 111. After the secondary pusher 40 is moved from one of the ends to the other end of the secondary channel hole 15, the engager 50 fully departs from the engaging part 111. With reference to FIG. 7, the blade 20 is pushed out of the opening of the casing 10 rapidly by the resilient element 60, thereby completing the extending of the blade 20.

To retract the blade 20, the user pulls the primary pusher 30 back to the axial inner end of the casing 10. At the time, the engager 50 is moved back to a position next to the engaging part 111, and is rotatable again. Thus, the engager 50 is rotated by the resilient element 60, and engages with the engaging part 111, such that the blade 20 is retracted and fixed in the casing 10 again.

Figure 10:
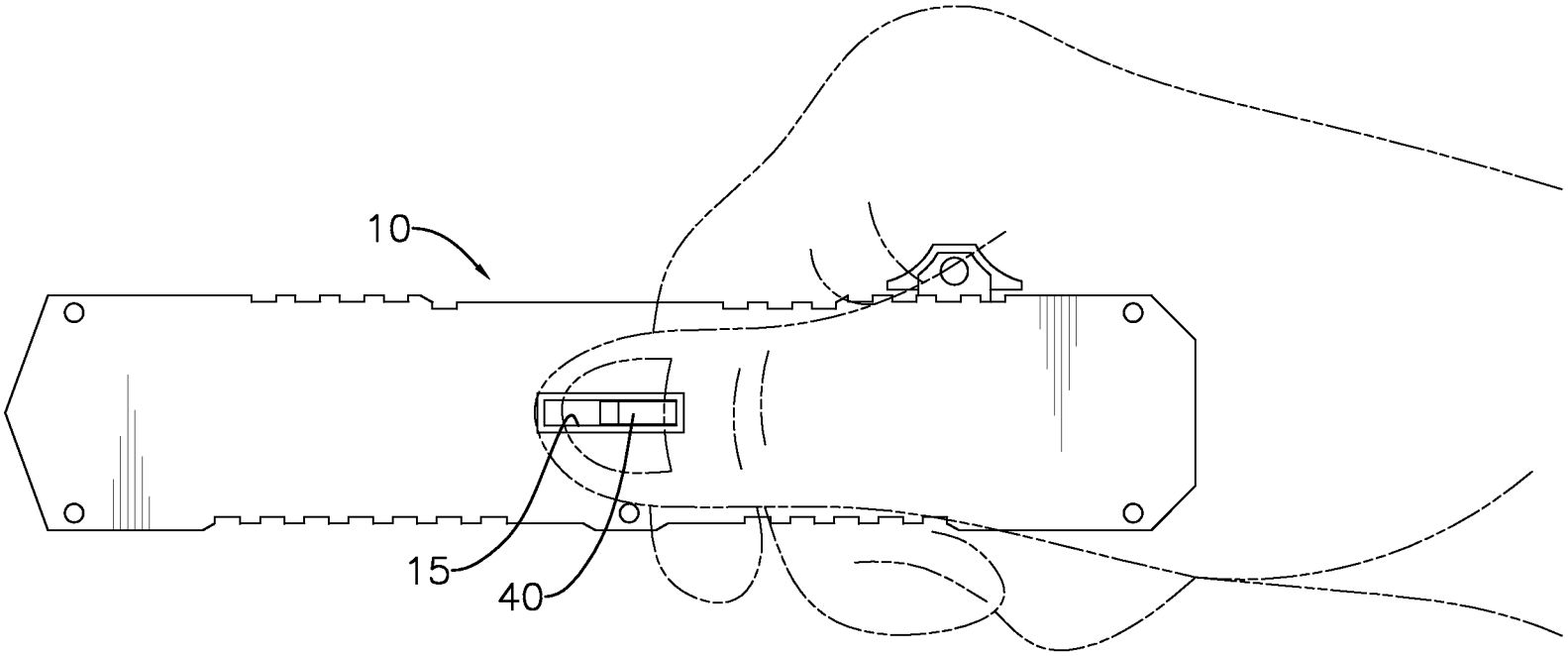
FIG. 10 is an operational view of the out the front assisted knife in FIG. 1, shown held in hand by a user.

With reference to FIG. 10, the secondary pusher 40, which can push and move the blade 20, is disposed away from the axial inner end of the casing 10, such that the user holds at least half of the casing 10 when about to extending the blade 20. Therefore, the user can hold the knife firmly by the center of gravity of the knife, and thus can stably and conveniently operate the knife, thereby preventing the knife from dropping accidentally and enhancing the safety in using.

With reference to FIG. 3, the panel 41 of the secondary pusher 40 corresponds to the panel recess 121 in shape, and the positioning holes 411 of the panel 41 are disposed around the positioning pins 122. As such, the movement of the panel 41 is effectively kept from deflection or displacement upon being pushed by the secondary pusher 40.

Figure 11:
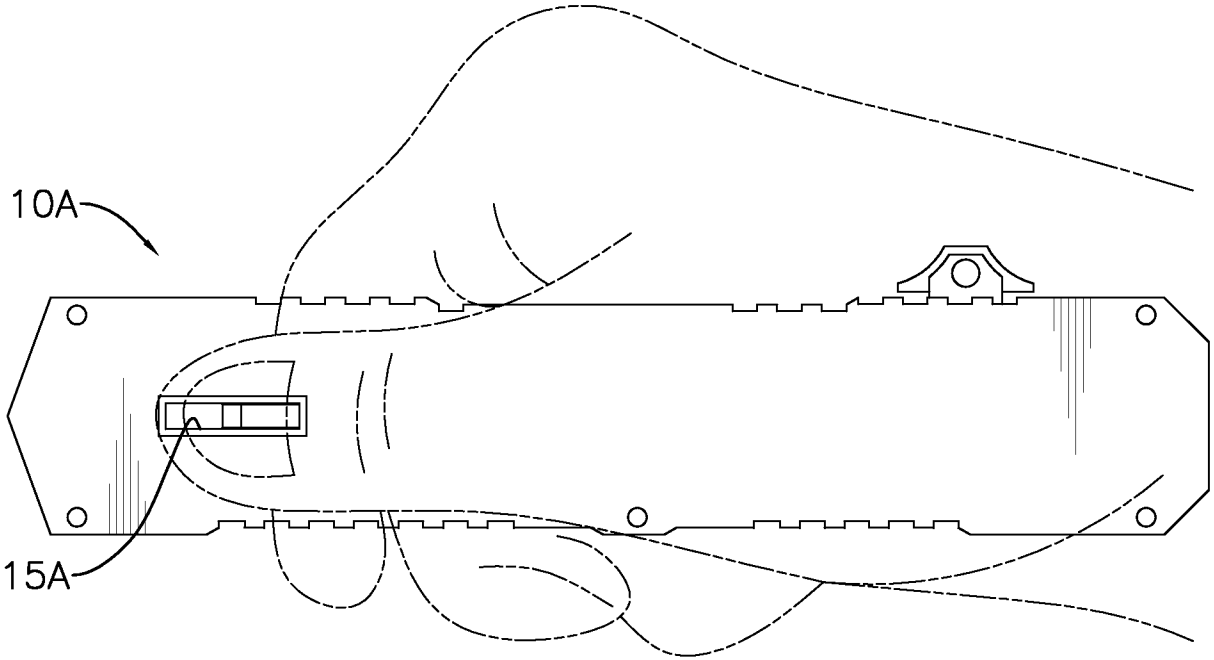
FIG. 11 is an operational view of another embodiment of the out the front assisted knife in FIG. 1, shown held in hand by a user.

With reference to FIG. 11, in another preferred embodiment, the secondary channel hole 15A is not disposed in the axial middle part of the casing 10A, and instead is disposed between the axial middle part and the axial outer end of the casing 10A. Accordingly, the user holds a larger portion of the casing 10A when about to extend the blade, such that the user can hold and operate the knife more firmly and stably.

In another embodiment, the structure of the casing is not limited to the first side casing, the channel board and the second side casing mentioned above, and may be altered in other forms.

In another embodiment, structures of the engager and the resilient element may be altered in other forms as long as the engager and the resilient element can achieve the function that the blade extends out of the casing only after being pushed for a distance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An out the front assisted knife having a blade that has to be pushed for a distance manually and then a resilient element takes over and extends the blade out the front of the knife, and comprising:

a casing having an axial inner end; an axial outer end; an inner space; an opening disposed in the axial outer end of the casing; a first channel hole formed through the casing such that a primary pusher outside the casing is coupled to the blade; and a secondary channel hole formed through the casing, extending axially, and disposed away from the axial inner end of the casing;

the blade axially movably mounted in the casing, and having an outer end selectively protruding out of the opening of the casing; and an inner end;

a secondary pusher axially movably mounted in the casing, protruding out of the secondary channel hole of the casing, and configured to axially abut against the inner end of the blade to initiate the blade movement towards the outer end; and the resilient element configured for pushing the blade out of the opening of the casing.

2. The out the front assisted knife as claimed in claim 1, wherein the secondary channel hole of the casing is disposed in an axial middle part of the casing.

3. The out the front assisted knife as claimed in claim 2, wherein a distance between the secondary channel hole and the axial inner end of the casing is equal to a distance between the secondary channel hole and the axial outer end of the casing.

4. The out the front assisted knife as claimed in claim 1, wherein the secondary channel hole of the casing is disposed between an axial middle part of the casing and the axial outer end of the casing.

5. The out the front assisted knife as claimed in claim 1, wherein the secondary pusher has a panel mounted in the casing and extending axially; and an abutting part formed transversely on an inner end of the panel, and axially abutting against the inner end of the blade.

6. The out the front assisted knife as claimed in claim 5, wherein the secondary pusher further has an operating part formed transversely on the panel, disposed adjacent to an outer end of the panel, and protruding out of the secondary channel hole of the casing; the operating part and the abutting part formed in opposite transverse directions on the panel.

7. The out the front assisted knife as claimed in claim 5, wherein the casing further has a panel recess formed in an inner wall of the casing, communicating with the secondary channel hole of the casing, extending axially, and corresponding to the panel of the secondary pusher in shape; and the panel of the secondary pusher is axially movably mounted in the panel recess of the casing.

8. The out the front assisted knife as claimed in claim 7, wherein the casing further has at least one positioning pin formed transversely on a bottom of the panel recess of the casing; and the panel of the secondary pusher further has at least one positioning hole formed through the panel, extending axially, and disposed around a corresponding one of the at least one positioning pin.

9. The out the front assisted knife as claimed in claim 5, wherein the casing further has at least one positioning pin formed transversely on an inner wall of the casing; and the panel of the secondary pusher further has at least one positioning hole formed through the panel, extending axially, and disposed around a corresponding one of the at least one positioning pin.

10. The out the front assisted knife as claimed in claim 1, wherein the casing has a first side casing;

a second side casing; and a channel board mounted between the first side casing and the second side casing;

the opening of the casing, the blade and the secondary pusher are disposed between the channel board and the second side casing; and the secondary channel hole is formed through the second side casing.

11. The out the front assisted knife as claimed in claim 1 further comprising an engager, wherein the casing further has an engaging part disposed in an inner wall of the casing;

the engager is mounted in the casing, is connected to the blade, and selectively engages with the engaging part of the casing; and the resilient element connects the casing and the engager.

* * * * *